US005277976A

United States Patent [19]

Hogle et al.

[11] Patent Number: 5,277,976

[45] Date of Patent: Jan. 11, 1994

[54] ORIENTED PROFILE FIBERS

[75] Inventors: Donald H. Hogle, Scandia; Peter M. Olofson, Oakdale, both of Minn.

[73] Assignee: Minnesota Mining and Manufacturing Company, St. Paul, Minn.

[21] Appl. No.: 772,236

[22] Filed: Oct. 7, 1991

[51] Int. Cl.[5] ..... D02G 3/00

[52] U.S. Cl. ..... 428/397; 428/395

[58] Field of Search ..... 428/224, 288, 397, 395

[56] References Cited

U.S. PATENT DOCUMENTS

| | | | |
|---|---|---|---|
| 2,945,739 | 7/1960 | Lehmicke | 18/54 |
| 3,121,040 | 2/1964 | Shaw et al. | 161/177 |
| 3,405,424 | 10/1968 | Imobersteg et al. | 18/8 |
| 3,465,618 | 9/1969 | McIntosh et al. | 76/107 |
| 3,478,389 | 11/1969 | Bradley et al. | 18/8 |
| 3,506,753 | 4/1970 | Flamand | 264/176 |
| 3,508,390 | 4/1970 | Bagnall et al. | 57/140 |
| 3,623,939 | 11/1971 | Ono et al. | 161/173 |
| 3,772,137 | 11/1973 | Tolliver | 161/169 |
| 3,860,679 | 1/1975 | Shemdin | 264/40 |
| 3,924,988 | 12/1975 | Hodge | 425/461 |
| 4,179,259 | 12/1979 | Belitsin et al. | 425/461 |
| 4,245,001 | 1/1981 | Phillips et al. | 428/224 |
| 4,325,765 | 4/1982 | Yu et al. | 156/167 |
| 4,364,998 | 12/1982 | Wei | 428/399 |
| 4,376,746 | 3/1983 | Ward et al. | 264/167 |
| 4,385,886 | 5/1983 | Samuelson | 425/464 |
| 4,405,688 | 9/1983 | Lowery et al. | 428/390 |
| 4,530,809 | 7/1985 | Shindo et al. | 264/210.7 |
| 4,541,981 | 9/1985 | Lowery et al. | 264/209.1 |
| 4,668,566 | 5/1987 | Braun | 428/286 |
| 4,670,341 | 6/1987 | Lundsager | 428/372 |
| 4,707,409 | 11/1987 | Phillips | 428/397 |
| 4,717,331 | 1/1988 | Maeda et al. | 425/467 |
| 4,909,976 | 3/1990 | Cuculo et al. | 264/211.15 |
| 5,057,368 | 10/1991 | Largman et al. | 428/397 |
| 5,200,248 | 4/1993 | Thompson et al. | 428/397 |

FOREIGN PATENT DOCUMENTS

| | | |
|---|---|---|
| WO91/09998 | 7/1991 | PCT Int'l Appl. . |
| WO91/12949 | 9/1991 | PCT Int'l Appl. . |
| 1171028 | 11/1969 | United Kingdom . |
| 1292388 | 2/1970 | United Kingdom . |
| 0272683 | 6/1986 | United Kingdom . |
| 2209672 | 5/1989 | United Kingdom . |

OTHER PUBLICATIONS

John Wiley & Sons, "Encyclopedia of Textiles, Fibers, and Nonwoven Fabrics", Encyclopedia Reprint Series, Editor: Martin Grayson.

*Primary Examiner*—James J. Bell

*Attorney, Agent, or Firm*—Gary L. Griswold; Walter N. Kirn; William J. Bond

[57] ABSTRACT

A method for providing a shaped fiber is provided, which shaped fiber closely replicates the shape of the die orifice. The polymer is spun at a melt temperature close to a minimum flow temperature and under a high drawdown.

13 Claims, 2 Drawing Sheets

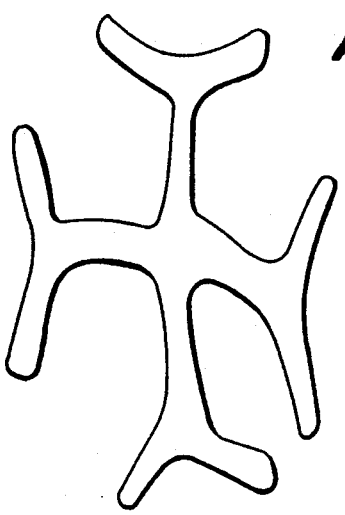
Fig. 4
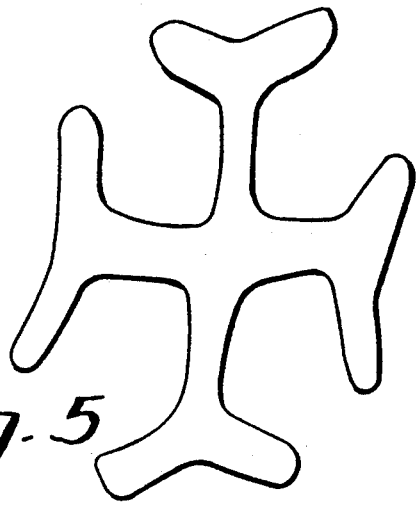
Fig. 5
Fig. 6
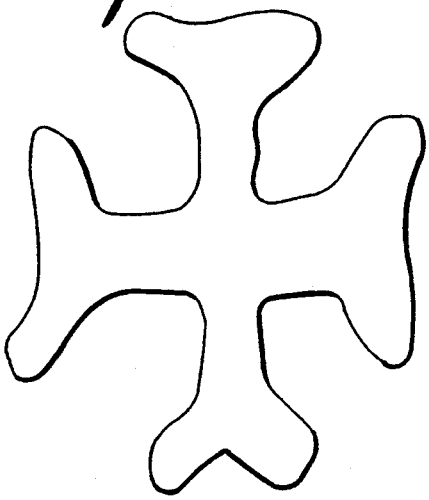
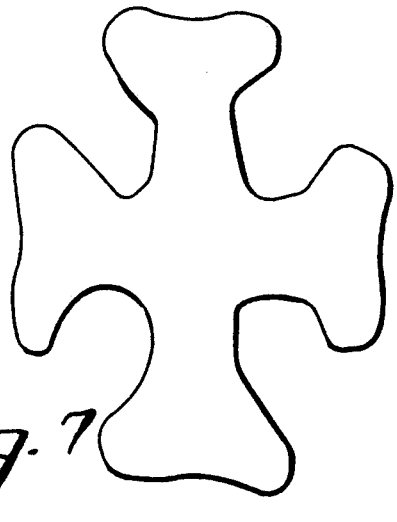
Fig. 7
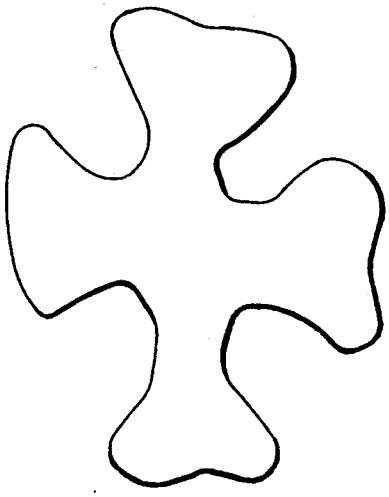
Fig. 8

ORIENTED PROFILE FIBERS

BACKGROUND AND FIELD OF THE INVENTION

The present invention relates to oriented, profiled fibers, the cross-section of which closely replicates the shape of the spinneret orifice used to prepare the fiber. The invention also relates to nonwoven webs comprising the oriented, profiled fibers.

Fibers having modified or non-circular cross-sections have been prepared by conventional fiber manufacturing techniques through the use of specially shaped spinneret orifices. However, correlation between the cross-section of fibers produced from these shaped orifices and the shape of the orifice is typically very low. The extruded polymer tends to invert to a substantially circular cross-section with a gently curved, undulating "amoeba-like" shape rather than the typical crisp, angled shape of the orifice. Numerous workers have proposed specially designed spinneret orifices which are used to approximate certain fiber cross-sections although generally there is little correspondence between the orifice cross-sectional shape and that of the fiber. Orifices are designed primarily to provide fibers with certain overall physical properties or characteristics associated with fibers within general classes of shapes. Orifices generally are not designed to provide highly specific shapes. Specialty orifices have been proposed in U.S. Pat. Nos. 4,707,409; 4,179,259; 3,860,679; 3,478,389; and 2,945,739 and U.K Patent No. 1,292,388.

U.S. Pat. No. 4,707,409 (Phillips) discloses a spinneret for the production of fibers having a "four-wing" cross-section. The fiber formed is either fractured in accordance with a prior art method or left unfractured for use as filter material. The "four-wing" shape of the fiber is obtained by use of a higher melt viscosity polymer and rapid quenching as well as the spinneret orifice design. The orifice is defined by two intersecting slots. Each intersecting slot is defined by three quadrilateral sections connected in series through an angle of less than 180°. The middle quadrilateral sections of each intersecting slot have greater widths than the other two quadrilateral sections of the same intersecting slot. Each slot intersects the other slot at its middle quadrilateral section to form a generally X-shaped opening. Each of the other two quadrilateral sections of each intersecting slot is longer than the middle quadrilateral section and has an enlarged tip formed at its free extremity.

U.S. Pat. No. 4,179,259 (Belitsin et al.) discloses a spinneret orifice designed to produce wool-like fibers from synthetic polymers. The fibers are alleged to be absorbent due to cavities formed as a result of the specialized orifice shapes. The orifice of one of the disclosed spinnerets is a slot with the configuration of a slightly open polygon segment and an L, T, Y or E shaped portion adjoining one of the sides of the polygon. The fibers produced from this spinneret orifice have cross-sections consisting of two elements, namely a closed ring shaped section resulting from the closure of the polygon segment and an L, T, Y, or E shaped section generally approximating the L, T, Y, or E shape of the orifice that provides an open capillary channel(s) which communicates with the outer surface of the fiber. It is the capillary channel(s) that provides the fibers with moisture absorptive properties, which assertedly can approximate those of natural wool. It is asserted that crimp is obtained that approximates that of wool. Allegedly this is due to non-uniform cooling.

U.S. Pat. No. 3,860,679 (Shemdin) discloses a process for extruding filaments having an asymmetrical T-shaped cross-section. The patentee notes that there is a tendency for asymmetrical fibers to knee over during the melt spinning tendency, which is reduced, for T-shaped fibers, using his orifice design. Control of the kneeing phenomena is realized by selecting dimensions of the stem and cross bars such that the viscous resistance ratio of the stem to the cross bar falls within a defined numerical range.

U.S. Pat. No. 3,478,389 (Bradley et al.) discloses a spinneret assembly and orifice designs suitable for melt spinning filaments of generally non-circular cross-section. The spinneret is made of a solid plate having an extrusion face and a melt face. Orifice(s) extend between the faces with a central open counter-bore melt receiving portion and a plurality of elongated slots extending from the central portion. In the counter-bore, a solid spheroid is positioned to divert the melt flow toward the extremities of the elongated slots. This counteracts the tendency of extruded melt to assume a circular shape, regardless of the orifice shape.

U.S. Pat. No. 2,945,739 (Lehmicke) describes a spinneret for the melt extrusion of fibers having non-circular shapes which are difficult to obtain due to the tendency of extruded melts to reduce surface tension and assume a circular shape regardless of the extrusion orifice. The orifices of the spinneret consist of slots ending with abruptly expanded tips. The fibers disclosed in this patent are substantially linear, Y-shaped or T-shaped.

Brit. Pat. 1,292,388 (Champaneria et al.) discloses synthetic hollow filaments (preferably formed of PET) which, in fabrics, provide improved filament bulk, covering power, soil resistance, luster and dye utilization. The cross-section of the filaments along their length is characterized by having at least three voids, which together comprise from 10–35% of the filament volume, extending substantially continuously along the length of the filament. Allegedly, the circumference of the filaments is also substantially free of abrupt changes of curvature, bulges or depressions of sufficient magnitude to provide a pocket for entrapping dirt when the filament is in side-by-side contact with other filaments. The filaments are formed from an orifice with four discrete segments. Melt polymer extruded from the four segments flows together to form the product filament.

It has also been proposed that improved replication of an orifice shape and departure from a substantially circular fiber cross-section can be achieved by utilizing polymers having higher melt viscosities; see, e.g., U.S. Pat. No. 4,364,998 (Wei). Wei discloses yarns based on fibers having cross-sections that are longitudinally splittable when the fibers are passed through a texturizing fluid jet. The fibers were extruded into cross-sectional shapes that had substantially uniform strength such that when they were passed through a texturizing fluid jet they split randomly in the longitudinal direction with each of the split sections having a reasonable chance of also splitting in the transverse direction to form free ends. Better retention of a non-round fiber shape was achieved with higher molecular weight polymers than with lower molecular weight polymers.

Rapid quenching has also been discussed as a method of preserving the cross-section of a melt extruded through a non-circular oriface. U.S. Pat. No. 3,121,040 (Shaw et al.) describes unoriented polyolefin fibers having a variety of non-circular profiles. The fibers were extruded directly into water to preserve the cross-sectional shape imparted to them by the spinneret orifice. This process freezes an amorphous or unoriented structure into the fiber and does not accommodate subsequent high ratio fiber draw-down and orientation. However, it is well known in the fiber industry that fiber properties are significantly improved through orientation. The superior physical properties of the oriented fibers of the present invention enable them to retain their shape under conditions where unoriented fibers would be subject to failure.

The surface tension forces of a polymer melt have also been used to advantage in the spinning of hollow circular fibers. For example, spinnerets designed for hollow fibers include some with multiple orifices configurated so that extruded melt polymer streams coalesce on exiting the spinneret to form a hollow fiber. Also, single orifice configurations with apertured chamber-like designs are used to form annular fibers. The extruded polymer on either side of the aperture coalesces on exiting the spinneret, to form a hollow fiber. Even though these spinneret designs on a casual inspection thus appear to be capable of producing fibers which would significantly depart from a substantially circular cross-section, surface tension forces in the molten polymer cause the extrudate to coalesce into hollow fibers having a cross-section that is substantially circular in shape.

It is also well known in the art that unoriented fibers with non-circular cross-sections will invert from their original shape toward substantially circular cross-sections when subjected to extensive draw-downs at standard processing conditions.

The use of specific polymers as a means of increasing orifice shape retention has also been suggested. Polymers with high viscosity or alternatively high molecular weight [presumably by decreasing flow viscosity] (see Wei above) have been proposed as a means of increasing replication of orifice shape. However, low molecular weight polymers are often desirable at least in terms of processability. For example, low molecular weight polymers exhibit less die swell and have been described as suitable for forming hollow microporous fiber, U.S. Pat. No. 4,405,688 (Lowery et al). Lowery et al described a specific upward spinning technique at high draw downs and low melt temperatures to obtain uniform high strength hollow microfibers.

Significant problems are associated with the techniques that are described for use in forming non-circular profiled shapes particularly with fibers. Highly designed orifice shapes are employed to give shapes that are generally ill defined, merely gross approximations of the actual oriface shape and possibly the actual preferred end shape. The surface tension and flow characteristics of the extruded polymer still tend to a circular form. Therefore, any sharp corners or well defined shapes are generally lost before the cross-sectional profile of the fiber is locked in by quenching.

A further problem arises in that the orientation of the above described fibers is accomplished generally by stretching the fibers after they have been quenched. This is generally limited to rather low draw rates below the break limit. Consequently, where a fiber of a certain denier is desired the die must be at the order of magnitude of the drawn fiber. This significantly increases costs if small or microfibers are sought due to the difficulties in milling or otherwise forming extremely small orifices with defined shapes. Finally, using a rapid quench to preserve shape creates an extremely unoriented fiber (see Shaw et al.) sacrificing the advantages of an oriented fiber for shape retention.

A general object of the present invention seeks to reconcile the often conflicting objectives, and resulting problems, of obtaining both oriented and highly structured or profiled fibers.

SUMMARY OF THE INVENTION

The present invention discloses extruded, non-circular, profiled, oriented shapes, particularly fibers. The method for making these shapes such as fibers includes using low temperature extrusion through structured, non-circular, angulate die orifices coupled with a high speed and high ratio draw down. The invention also discloses nonwoven webs comprising the oriented, non-circular, profiled fibers.

BRIEF DESCRIPTION OF THE DRAWINGS

FIG. 4–8 are representations of cross-sections of fibers produced as described in Examples 1–5, respectively.

DETAILED DESCRIPTION OF THE INVENTION

Figure 1:
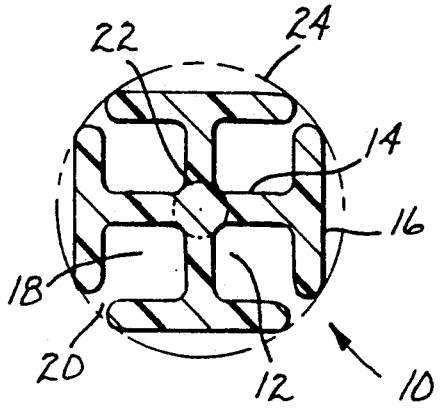
FIG. 1 is a schematic representation of one configuration of an oriented, profiled fiber of the present invention.

The present invention provides for oriented structured shapes, particularly fibers having a non-circular profiled cross-section. More specifically, the invention provides a method, and product, wherein the cross-section of the extruded article closely replicates the shape of the orifice used to prepare the shaped article.

Fibers formed by the present invention are unique in that they have been oriented to impart tensile strength and elongation properties to the fibers while maintaining the profile imparted to a fiber by the spinneret orifice.

The method of the present invention produces fine denier fibers with high replication of the profile of the much larger original orifice while (simply and efficiently) producing oriented fibers.

The process initially involves heating a thermoplastic polymer (e.g., a polyolefin) to a temperature slightly above the crystalline phase transition temperature of the thermoplastic polymer. The so-heated polymer is then extruded through a profiled die face that corresponds to the profile of the to be formed, shaped article. The die face orifice can be quite large compared to those previously used to produce profiled shapes or fibers. The shaped article when drawn may also be passed through a conditioning (e.g., quench) chamber. This conditioning or quench step has not been found to be critical in producing high resolution profiled fibers, but rather is used to control morphology. Any conventional cross-flow quench chamber can be used. This is unexpected in that dimensional stability has been attributed to uniform quench in the past; see, e.g., Lowery et al. U.S. Pat. No. 4,551,981. Lowery et al. attributed uniform wall thickness of hollow circular fibers to a uniform quench operation.

The die orifices can be of any suitable shape and area. Generally, however, at the preferred draw ratios employed, fiber die orifices will generally have an overall outside diameter of from 0.050 to 0.500 in. and a length of at least 0.125 in. These dimensions are quite large compared to previous orifices for producing oriented fibers of similar cross-sectional areas where shape retention was a concern. This is of great significance from a manufacturing prospective as it is much more costly and difficult to produce intricate profiled orifices of extremely small cross-sectional areas. Further, this orifice and associated spinning means can be oriented in any suitable direction and still obtain significant shape retention.

The oriented, profiled shapes of the present invention are prepared by conventional melt spinning equipment with the thermoplastic polymer at temperatures from about 10°-90° C. and more preferably from about 10°-50° C. above the minimum flow temperature (generally the crystalline melt temperature) of the polymer. Spinning the shaped articles of the present invention at a temperature as close to the melt temperature of the polymer as possible contributes to producing shaped articles having increased cross-sectional definition or orifice replication.

A variety of extrudable or fiber-forming thermoplastic polymers including, but not limited to, polyolefins (i.e., polyethylene, polypropylene, etc.), polyesters (i.e., polyethylene terephthalate, etc.), polyamides (i.e., nylon 6, nylon 66, etc.), polystyrene, polyvinyl alcohol and poly(meth)acrylates, polyimides, polyaryl sulfides, polyaryl sulfones, polyaramides, polyaryl ethers, etc. are useful in preparing the shaped articles or fibers of the present invention. Preferably, the polymers can be oriented to induce crystallinity for crystalline polymers and/or improve fiber properties.

A relatively high draw down is conducted as the fiber is extruded. This orients the fiber at or near the spinneret die face rather than in a subsequent operation. The drawdown significantly reduces the cross-sectional area of the fibers yet surprisingly without losing the profile imparted by the spinneret orifice. The draw down is generally at least 10:1, preferably at least 50:1, and more preferably at least about 100:1, with draw downs significantly greater than this possible. For these draw down rates, the cross-section of the fiber will be diminished directly proportional to the drawdown ratio.

The quenching step is not critical to profile shape retention and cost effective cross flow cooling can be employed. The quenching fluid is generally air, but other suitable fluids can be employed. The quenching means generally is located close to the spinneret face.

Oriented, profiled fibers of the present invention can be formed directly into non-woven webs by a number of processes including, but not limited to, spun bond or spun lace processes and carding or air laying processes.

It is anticipated that the invention fibers could comprise a component of a web for some applications. For example, when the profiled fibers are used as absorbents generally at least about 10 weight percent of the oriented, profiled fibers of the present invention are used in the formed webs. Further, the fibers could be used as fluid transport fibers in nonwoven webs which may be used in combination with absorbent members such as wood fluff pads. Other components which could be incorporated into the webs include natural and synthetic textile fibers, binder fibers, deodorizing fibers, fluid absorbent fibers, wicking fibers, and particulate materials such as activated carbons or super-absorbent particles.

Preferred fibers for use as absorbent or wicking fibers should have a partially enclosed longitudinal space with a coextensive longitudinal gap along the fiber length. This gap places the partially enclosed space in fluid communication with the area external of the fiber. Preferably, the gap width should be relatively small compared to the cross-sectional perimeter of the partially enclosed space (including the gap width). Suitable fibers for these applications are set forth in the examples. Generally, the gap width should be less than 50 percent of the enclosed space cross-sectional perimeter, preferably less than 30 percent.

The webs may also be incorporated into multi-layered, nonwoven fabrics comprising at least two layers of nonwoven webs, wherein at least one nonwoven web comprises the oriented, profiled fibers of the present invention.

As fluid transport fibers, the fibers can be given anisotropic fluid transport properties by orientation of nonwoven webs into which the fibers are incorporated. Other methods of providing anisotropic fluid transport properties include directly laying fibers onto an associated substrate (e.g., a web or absorbent member) or the use of fiber tows.

Basis weights of the webs can encompass a broad range depending on the application, however they would generally range from about 25 gm/m$^2$ to about 500 gm/m$^2$.

Nonwoven webs produced by the aforementioned processes are substantially non-unified and, as such, generally have limited utility, but their utility can be significantly increased if they are unified or consolidated. A number of techniques including, but not limited to, thermomechanical (i.e. ultrasonic) bonding, pin bonding, water- or solvent-based binders, binder fibers, needle tacking, hydroentanglement or combinations of various techniques, are suitable for consolidating the nonwoven webs.

It is also anticipated that the oriented fibers of the present invention will also find utility in woven and knitted fabrics.

The profiled fibers prepared in accordance with the teaching of the invention will have a high retention of the orifice shape. The orifice can be symmetrical or asymmetrical in its configuration. With symmetrical or asymmetrical type orifices shapes, there is generally a core member 12, as is illustrated in FIG. 1, from which radially extending profile elements radiate outward. These profile elements can be the same or different, with or without additional structural elements thereon. However, asymmetrical shapes such as C-shaped or S-shaped fibers will not necessarily have a defined core element.

Referring to FIG. 1, which schematically represents a cross-section 10 of a symmetrical profiled fiber according to the present invention, the fiber comprises a core member 12, structural profile elements 14, intersecting components 16, chambers 18 and apertures 20. Diameter ($D_{fib}$) is that of the smallest circumscribed circle 24 which can be drawn around a cross-section of the fiber 10, such that all elements of the fiber are included within the circle. Diameter ($d_{fib}$) is that of the largest inscribed circle 22 that can be drawn within the intersection of a core member or region and structural profile elements or, if more than one intersection is present, the largest inscribed circle that can be drawn within the largest intersection of fiber structural profile elements, such that the inscribed circle is totally contained within the intersection structure.

Figure 2:
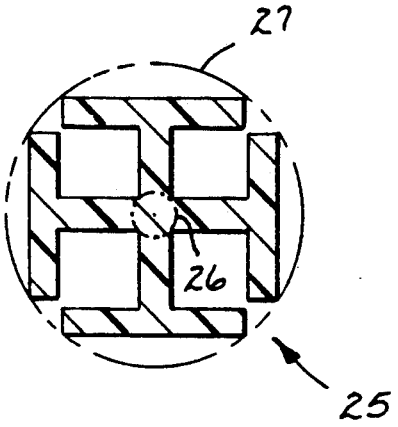
FIG. 2 is a plan view of an orifice of a spinneret used to prepare the fiber of FIG. 1.

FIG. 2 schematically represents the spinneret orifice used to prepare the fiber of FIG. 1. Diameter ($D_{orf}$) is that of the smallest circumscribed circle 26 that can be drawn around the spinneret orifice 25, such that all elements of the orifice are included within the circle. Diameter ($d_{orf}$) is that of the largest inscribed circle 27 that can be drawn within the intersection of a core member orifice member or region with orifice structural profile elements or, if more than one intersection is present, the largest inscribed circle that can be drawn within the largest intersection of orifice profile element, such that the inscribed circle is totally contained within the intersection structure.

Normalization factors for both symmetrical and asymmetrical fibers are the ratio of the cross-sectional area, of the orifice or the fiber ($A_{orf}$ and $A_{fib}$), to the square of $D_{fib}$ or $D_{orf}$, respectively. Two normalization factors result, $X_{fib}(A_{fib}/D_{fib}^2)$ and $X_{orf}(A_{orf}/D_{orf}^2)$, which can be used to define a structural retention factor (SRF). The SRF is defined by the ratio of $X_{fib}$ to $X_{orf}$. These normalization factors are influenced by the relative degree of open area included within the orifice or fiber structure. If these factors are similar (i.e., the SRF is close to 1), the orifice replication is high. For fibers with low replication, the outer structural elements will appear to collapse resulting in relatively high values for $X_{fib}$ and hence larger values for SRF. Fibers with perfect shape retention will have a SRF of 1.0, generally the fibers of the invention will have a SRF of about 1.4 or less and preferably of about 1.2 or less. However, due to the dependence of this test on changes in open area from the orifice to the fiber, there is a loss in sensitivity of this test (SRF) as a measure of shape retention as the orifice shape approaches a circular cross section.

A second structural retention factor (SRF2) is related to the retention of perimeter. With low shape retention fibers the action of coalescing of the fiber into a more circular form results in smaller ratios of perimeter to fiber area. The perimeters ($P_{orf}$ and $P_{fib}$) are normalized for the die orifice and the fiber by taking the square of the perimeter and dividing this value by the square of $D_{orf}$ or $D_{fib}$ or fiber or orifice area (A), respectively. These ratios are defined as $Y_{orf}$ and $Y_{fib}$. For a perfectly circular die orifice or fiber, the ratio $Y_{cir}$ ($cir^2$/Air) will equal $4\pi$ or about 12.6. The SRF2 ($Y_{orf}/Y_{fib}$) is a function of the deviation of $Y_{orf}$ from $Y_{circle}$. As a rough guide, generally, the SRF2 for the invention fibers is below about 4 for ratios of $Y_{orf}$ to $Y_{cir}$ greater than 20 and below about 2 for ratios of $Y_{orf}$ to $Y_{cir}$ of less than about 20. This is a rough estimate as SRF2 will approach a value of 1 as the orifice shape approaches that of a circle for either the invention method or for prior art methods used for shape retention. However, the invention method will still produce a fiber having an SRF2 closer to 1 for a given die orifice shape.

The orifice shape used in the invention method is non-circular (e.g., neither circular nor annular, or the like), such that it has an external open area of at least 10 percent. The external open area of the die is defined as the area outside the die orifice outer perimeter (i.e., excluding open area completely circumscribed by the die orifice) and inside $D_{orf}$. Similarly, the external open area of the fibers is greater than 10 percent, preferably greater than 50 percent. This again excludes open area completely circumscribed by the fiber but not internal fiber open area that is in direct fluid communication with the space outside the fiber, such as by a lengthwise gap in the fiber. With conventional spinning techniques using orifices having small gaps, the gap will typically not be replicated in the fiber. For example, in the fiber these gaps will collapse and are typically merely provided in the orifice to form hollow fibers (i.e., fibers with internal open area, only possibly in indirect fluid communication with the space outside the fiber through any fiber ends).

Figure 3:
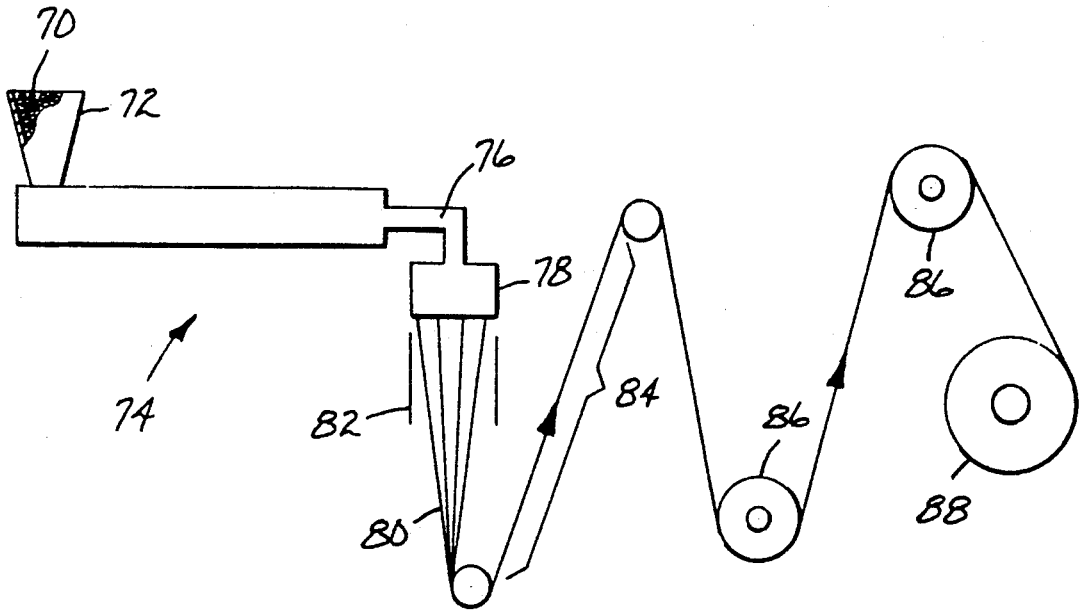
FIG. 3 is an illustration of a fiber spinning line used to prepare the fibers of the present invention.

FIG. 3 is a schematic illustration of a suitable fiber spinning apparatus arrangement useful in practicing the method of the present invention. The thermoplastic polymer pellets are fed by a conventional hopper mechanism 72 to an extruder 74, shown schematically as a screw extruder but any conventional extruder would suffice. The extruder is generally heated so that the melt exits the extruder at a temperature above its crystalline melt temperature or minimum flow viscosity. Preferentially, a metering pump is placed in the polymer feed line 76 before the spinneret 78. The fibers 80 are formed in the spinneret and subjected to an almost instantaneous draw by Godet rolls 86 via idler rolls 84. The quench chamber is shown as 82 and is located directly beyond the spinneret face. The drawn fibers are then collected on a take-up roll 88 or alternatively they can be directly fabricated into nonwoven webs on a rotating drum or conveyer belt. The fibers shown here are downwardly spun, however other spin directions are possible.

The following examples are provided to illustrate presently contemplated preferred embodiments and the best mode for practicing the invention, but are not intended to be limiting thereof.

EXAMPLES

The extruder used to spin the fibers was a Killon TM ¾ inch, single screw extruder equipped with a screw having an L/D of 30, a compression ratio of 3.3 and a configuration as follows: feed zone length, 7 diameters; transition zone length, 8 diameters; and metering zone length 15 diameters. The extruded polymer melt stream was introduced into a Zenith TM melt pump to minimize pressure variations and subsequently passed through an inline Koch TM Melt Blender (#KMB-100, available from Koch Engineering Co., Wichita, Kans.) and into the spinneret having the configurations indicated in the examples. The temperature of the polymer melt in the spinneret was recorded as the melt temperature. Pressure in the extruder barrel and downstream of the Zenith TM pump were adjusted to give a polymer throughput of about 1.36 kg/hr (3 lbs/hr). On emerging from the spinneret orifices, the fibers were passed through an air quench chamber, around a free spinning turnaround roller, and onto a Godet roll which was maintained at the speed indicated in the example. Fibers were collected on a bobbin as they came off the Godet roll.

The cruciform spinneret (FIG. 2) consisted of a 10.62 cm×3.12 cm×1.25 cm (4.25"×1.25"×0.50") stainless steel plate containing three rows of orifices, each row containing 10 orifices shaped like a cruciform. The overall width of each orifice (27) was a 6.0 mm (0.24"), with a crossarm length of 4.80 mm (0.192"), and a slot width of 0.30 mm (0.012"). The upstream face (melt stream side) of the spinneret had conical shaped holes centered on each orifice which tapered from 10.03 mm (0.192") on the spinneret face to an apex at a point 3.0 mm (0.12") from the downstream face (air interface side) or the spinneret (55° angle). The L/D for each orifice, as measured from the apex of the conical hole to the downstream face of the spinneret, was 10.0.

A swastika spinneret was used which consisted of a 10.62 cm×3.12 cm×1.25 cm (4.25"×1.25"×0.50") stainless steel plate with a single row of 12 orifices, each orifice shaped like a swastika. A depression which was 1.52 mm (0.06") deep was machined into the upstream face (melt stream side) of the spinneret leaving a 12.7 mm (0.5") thick lip around the perimeter of the spinneret face. The central portion of the spinneret was 11.18 mm (0.44") thick. The orifices were divided into four groups, with each group of three orifices having the same dimensions. All of the orifices had identical slot widths of 0.15 mm (0.006") and identical length segments of 0.52 mm (0.021") extending from the center of the orifice (segments A of FIG. 2). The length of segments B and C for the orifices of group 1 were 1.08 mm (0.043") and 1.68 mm (0.067"), respectively, the length of segments B and C for the orifices of group 2 were 1.08 mm (0.043"), and 1.52 mm (0.60"), respectively, the lengths of segments B and C for the orifices of group 3 were 1.22 mm (0.049") and 1.68 mm (0.067"), respectively, and the length of segments B and C for the orifices of group 4 were 1.22 mm (0.049") and 1.52 mm (0.060"), respectively. The orifice depth for all of the swastika orifices was 1.78 mm (0.070"), giving a L/D of 11.9. The upstream face of the spinneret had conical holes centered on each orifice which were 9.40 mm (0.037") in length and tapered from 6.86 mm (0.027") at the spinneret face to 4.32 mm (0.017") at the orifice entrance. Shape retention properties of fibers extruded through the various groups of orifices of the swastika design were substantially identical.

EXAMPLE 1

Shaped fibers of the present invention were prepared by melt spinning Dow ASPUN TM 6815A, a linear low-density polyethylene available from Dow Chemical, Midland Mich., having a melt flow index (MFI) of 12 through the cruciform spinneret described above at a melt temperature of 138° C. and the resulting fibers cooled in ambient air (i.e., there was no induced air flow in the air quench chamber). The fibers were attenuated at a Godet speed of 30.5 m/min. (100 ft/min.). Fiber characterization data is presented in Tables 1 and 2.

EXAMPLE 2

Shaped fibers of the present invention were prepared according to the procedures of Example 1 except that the melt temperature was 171° C.

EXAMPLE 3

Shaped fibers of the present invention were prepared according to the procedures of Example 1 except that the melt temperature was 204° C.

EXAMPLE 4

Shaped fibers of the present invention were prepared according to the procedures of Example 1 except that the melt temperature was 238° C.

EXAMPLE 5

Shaped fibers of the present invention were prepared according to the procedures of Example 1 except that the melt temperature was 260° C.

TABLE 1

| Exam. No. | Melt Temp. (°C.) | Figure | Area (A) | Diam. (D) | Prmtr. (P) |
|---|---|---|---|---|---|
| Orifice | | 2 | 19,936 | 336 | 2690 |
| 1 | 138 | 4 | 27,932 | 402 | 2141 |
| 2 | 171 | 5 | 39,133 | 418 | 2154 |
| 3 | 204 | 6 | 54,475 | 398 | 1981 |
| 4 | 238 | 7 | 59,389 | 396 | 1730 |
| 5 | 260 | 8 | 56,362 | 388 | 1609 |

Table 1 sets forth the cross-sectional area, perimeter and diameter ($D_{fib}$ and $D_{orf}$) for the fibers of Examples 1–5 and the orifice from which they were formed using image analysis. FIGS. 3 and 6–10 show cross-sections for the orifices and the fibers subject to this image analysis. As can be seen in these figures, resolution of the orifice cross-section is quickly lost as the melt temperature is increased at the spinning conditions for Example 1.

Table 2 sets forth SRF and SRF2 for Examples 1–5 and the cruciform orifice.

TABLE 2

| Exam. No. | Open Area | Normalization Factor X ($A/D^2$) | SRF $X_{fib}/X_{orf}$ | Normalization Factor Y ($P^2/A$) | SRF2 $Y_{orf}/Y_{fib}$ |
|---|---|---|---|---|---|
| Cruciform | 77.5% | 0.1766 | | 363.0 | |
| 1 | 78.0% | 0.1728 | 0.98 | 164.0 | 2.2 |
| 2 | 71.5% | 0.2240 | 1.27 | 118.6 | 3.16 |
| 3 | 56.2% | 0.3439 | 1.95 | 72.0 | 5.0 |
| 4 | 51.8% | 0.3787 | 2.14 | 50.4 | 7.2 |
| 5 | 52.3% | 0.3743 | 2.12 | 45.9 | 7.91 |

The open area for this series of examples is the difference between the fiber cross-sectioned area and the area of a circle corresponding to $d_{orf}$ or $d_{fib}$.

EXAMPLE 6

Shaped fibers of the present invention were prepared according to the procedures of Example 1 except that an 80/20 (wt./wt.) blend of Fina 3576X, a polypropylene (PP) having an MFI of 9, available from Fina Oil and Chemical Co., Dallas, Tex., and Exxon 3085, a polypropylene having an MFI of 35, available from Exxon Chemical, Houston, Tex., was substituted for the ASPUN TM 6815A, and the melt temperature was 260° C.

EXAMPLES 7 AND 8

Shaped fibers of the present invention were prepared according to the procedures of Example 6 except that the melt temperature was 271° C. Fibers from two different orifices were collected and analyzed.

EXAMPLE 9

Shaped fibers of the present invention were prepared according to the procedures of Example 1 except that Tennessee Eastman Tenite TM 10388, a poly(ethylene terephthalate) (PET) having an I.V. of 0.95, available from Tennessee Eastment Chemicals, Kingsport, Tenn., was substituted for the ASPUN TM 6815A, the melt temperature was 280° C., and the fibers were attenuated at a Godet speed of 15.3 m/min. (50 ft/min.). The PET resin was dried according to the manufacturer's directions prior to using it to prepare the fibers of the invention.

EXAMPLE 10

Shaped fibers of the present invention were prepared according to the procedures of Example 9 except that the melt temperature was 300° C.

EXAMPLE 11

Shaped fibers of the present invention were prepared according to the procedures of Example 9 except that the melt temperature was 320° C.

EXAMPLE 12

Shaped fibers of the present invention were prepared according to the procedures of Example 1 except that the swastika spinneret was substituted for the cruciform spinneret, the melt temperature was 138° C., and the air temperature in the quench chamber was maintained at 35° C. by an induced air flow.

Table 3 sets forth the cross-sectional dimensions for Examples 6–12, and Table 4 sets forth the shape retention factors SRF and SRF2, as well as percent open area.

TABLE 3

| Exam. No. | Melt Temp. (°C.) | Area (A) | Diam. (D) | Prmtr. (P) |
|---|---|---|---|---|
| 6 | 260 | 28,523 | 346 | 1663 |
| 7 | 271 | 24,470 | 332 | 1608 |
| 8 | 271 | 28,308 | 350 | 1684 |
| 9 | 280 | 19,297 | 342 | 1458 |
| 10 | 300 | 31,247 | 336 | 1571 |
| 11 | 320 | 76,898 | 338 | 890 |
| Swastika | | 23,625 | 392 | 2764 |
| 12 | 138 | 31,384 | 384 | 1930 |

TABLE 4

| Exam. No. | Open Area | Normalization Factor X ($A/D^2$) | SRF $X_{fib}/X_{orf}$ | Normalization Factor Y ($P^2/A$) | SRF2 $Y_{orf}/Y_{fib}$ |
|---|---|---|---|---|---|
| 6 | 69.7% | 0.238 | 1.35 | 97.0 | 3.7 |
| 7 | 71.7 | 0.222 | 1.26 | 106 | 3.4 |
| 8 | 70.6 | 0.231 | 1.31 | 100 | 3.6 |
| 9 | 79.0 | 0.165 | 0.934 | 110 | 3.3 |
| 10 | 64.8 | 0.277 | 1.57 | 79.0 | 4.6 |
| 11 | 14.3 | 0.673 | 3.81 | 10.3 | 35.2 |
| Swastika | 80.4 | 0.154 | | 323 | — |

TABLE 4-continued

| Exam. No. | Open Area | Normalization Factor X ($A/D^2$) | SRF $X_{fib}/X_{orf}$ | Normalization Factor Y ($P^2/A$) | SRF2 $Y_{orf}/Y_{fib}$ |
|---|---|---|---|---|---|
| 12 | 72.9 | 0.213 | 1.38 | 119 | 2.7 |

Tables 3 and 4 illustrate the sensitivity of PP and PET to melt temperature and the use of a different die orifice shape. PET showed quite a sharp dependence on melt temperature. However, at low melt temperatures, relative to the polymer melting temperature, both PP and PET provided excellent fiber replication of the oriface shapes.

COMPARATIVE EXAMPLES

These examples (Table 5) represent image analysis performed on fibers produced in various prior art patents directed at obtaining shaped (e.g., non-circular fibers or hollow fibers) fibers. The analysis was performed on the fibers represented in various figures from these documents.

TABLE 5

| Reference | Die Fig. | Fiber Fig. | Prmtr. (P) | Area (A) | D | $X(A/D^2)$ | SRF $X_{fib}/X_{orf}$ | Open Area % | $Y(P^2/A)$ | SRF2 $Y_{orf}/Y_{fib}$ |
|---|---|---|---|---|---|---|---|---|---|---|
| GB 1,292,388 | 1 | | 3,085 | 29,334 | 420 | 0.1663 | 3.31 | 78.8 | | 7.48 |
| GB 1,292,388 | | 1A | 1,663 | 63,606 | 340 | 0.3502 | | 21.5 | | |
| U.S. Pat. No. 3,478,389 | 4A | | 1,536 | 28,845 | 394 | 0.1858 | 2.33 | 76.3 | 81.2 | 4.44 |
| U.S. Pat. No. 3,478,389 | | 4C | 1,122 | 68,679 | 398 | 0.4336 | | 44.8 | 18.3 | |
| U.S. Pat. No. 3,772,137 | 1 | | 1,839 | 37,700 | 392 | 0.2453 | | 68.8 | 89.7 | 2.12 |
| U.S. Pat. No. 3,772,137 | | 2 | 1,723 | 70,103 | 396 | 0.4470 | 1.82 | 18.4 | 42.3 | |
| U.S. Pat. No. 4,179,259 | 4 | | 2,196 | 15,765 | 344 | 0.1332 | 2.02 | 83.0 | 305.9 | 3.40 |
| U.S. Pat. No. 4,179,259 | | 5 | 1,897 | 40,018 | 386 | 0.2686 | | 55.3 | 89.9 | |
| U.S. Pat. No. 4,707,409 | 12 | | 1,658 | 13,996 | 382 | 0.0959 | 1.76 | 87.8 | 196.4 | 2.12 |
| U.S. Pat. No. 4,707,409 | | 13 | 1,526 | 25,164 | 386 | 0.1689 | | 78.5 | 92.5 | |
| U.S. Pat. No. 4,472,477 | 21 | | 1,044 | 14,206 | 384 | 0.0963 | 1.99 | 87.7 | 76.7 | 2.51 |
| U.S. Pat. No. 4,472,477 | | 22 | 924 | 28,009 | 382 | 0.1919 | | 75.6 | 30.5 | |
| U.S. Pat. No. 4,408,977 | 33 | | 1,377 | 14,357 | 412 | 0.0846 | 1.88 | 89.2 | 132.1 | 2.89 |
| U.S. Pat. No. 4,408,977 | | 34 | 1,052 | 24,233 | 390 | 0.1593 | | 79.7 | 45.7 | |
| EPO 391,814 | 3 | | 2,413 | 9,561 | 366 | 0.0714 | 5.16 | 90.9 | 609 | 6.69 |
| EPO 391,814 | | 10 | 2,256 | 56,062 | 390 | 0.3686 | | 53.1 | 91 | |
| EPO 391,814 | 4 | | 3,451 | 9,232 | 390 | 0.0533 | 5.36 | 93.2 | 12.90 | |
| EPO 391,814 | | 11 | 3,484 | 40,377 | 378 | 0.2826 | | 64.0 | 300 | 4.3 |
| EPO 391,814 | 5 | | 3,329 | 11,193 | 396 | 0.0714 | 5.67 | 90.9 | 990 | |
| EPO 391,814 | | 13 | 2,629 | 55,408 | 370 | 0.4047 | | 48.5 | 125 | 7.92 |
| U.S. Pat. No. 4,392,808 | 1 | | 2,742 | 22,831 | 400 | 0.1427 | 0.94 | 81.8 | 329.3 | 7.43 |
| U.S. Pat. No. 4,392,808 | | 2 | 987 | 21,973 | 404 | 0.346 | | 82.9 | 44.3 | |

In certain of these comparative examples (i.e., GB 1,292,388, U.S. Pat. Nos. 3,772,137 and 4,179,259), the open area is calculated by excluding area completely circumscribed by the fiber in the cross-section.

For certain patents, it is uncertain if the figures are completely accurate representations of the fibers formed by these patents, however it is reasonable to assume that these are at least valid approximations. As can be seen, none of the comparative example fibers retain the shape of the die orifices to the degree of Examples 1, 2, 6–9 or 12 as represented by SRF, SRF2 and the percent open area.

The various modifications and alterations of this invention will be apparent to those skilled in the art without departing from the scope and spirit of this invention, and this invention should not be restricted to that set forth herein for illustrative purposes.

We claim:

1. Oriented non-circular fibers comprising elongate spun fibers having a non-circular cross-section defined by:

$$SRF = X_{orf}/X_{fib} < 1.3$$

where X is defined as the ratio of the fiber or orifice cross-sectional area (A) to the square of the fiber or orifice diameter (D), and $$SRF2 = Y_{orf}/Y_{fib} < 3.5$$

for fibers formed from dies where $Y_{orf}/4\pi > 20$, or $$SRF2 = Y_{orf}/Y_{fib} < 2.0$$

for fibers formed from dies where $Y_{orf}/4\pi < 20$, where Y is defined as the ratio of the fiber or orifice perimeter squared to the fiber or orifice cross-sectional area, said fibers formed by a process comprising the steps of:

heating at least a portion of a contained flow path formed by a conduit means, said flow path defining conduit means having at least one thermoplastic material inlet and at least one thermoplastic material outlet, providing a non-circular profiled orifice at said at least one thermoplastic material outlet which orifice is in communication with a second fluid region, passing a thermoplastic material through said heated portion of said contained flow path such as to heat said material to a temperature about 10°-90° C. above its crystalline phase transition temperature or minimum flow viscosity to form a fluid thermoplastic stream, forming said fluid thermoplastic stream into a profiled stream substantially corresponding to the shape of said orifice while passing said stream from said flow path into said second fluid region, orienting said profiled stream in said second fluid region by drawing said profiled stream at a draw down rate of at least 10 while cooling said profiled stream with a quenching fluid in said second fluid region, wherein a fiber is formed having a profile substantially identical to that of said profiled thermoplastic stream.

2. The non-circular fibers of claim 1 wherein SRF2 is less than about 1.1.

3. The non-circular fibers of claim 1 wherein SRF2 is less than about 3.5 for fibers where $Y_{orf}/4\pi$ is greater than 20 and less than about 2.0 for fibers where $Y_{orf}/4\pi$ is less than 20.

4. The non-circular fibers of claim 1 wherein the fibers have an external open area of greater than about 10 percent.

5. The non-circular fibers of claim 1 wherein the fibers have an external open area of greater than about 50 percent.

6. The oriented, non-circular fibers of claim 1 wherein said profiled fibers comprise a fiber forming thermoplastic orientable material.

7. The oriented, non-circular fibers of claim 6 wherein said fiber forming thermoplastic material comprises a polyolefin, a polyester or a polyamide.

8. The oriented, non-circular fibers of claim 7 wherein said thermoplastic material comprises polyethylene.

9. The oriented, non-circular fibers of claim 7 wherein said thermoplastic material comprises polypropylene.

10. The oriented, non-circular fibers of claim 7 wherein said thermoplastic material comprises polyethylene terephthalate.

11. The oriented, non-circular fibers of claim 1 wherein the fibers have a partially enclosed space for fluid absorption or fluid wicking.

12. The oriented, non-circular fibers of claim 11 wherein the fibers have a partially enclosed space that extends longitudinally along the fiber length and is in communication with external area by a coextensive longitudinal gap wherein the gap width is less than 50 percent of the perimeter of the partially enclosed space.

13. The oriented, non-circular fibers of claim 11 wherein the fibers have a partially enclosed space that extends longitudinally along the fiber length and is in communication with external area by a coextensive longitudinal gap wherein the gap width is less than 30 percent of the perimeter of the partially enclosed space.

* * * * *